US009327179B2

(12) United States Patent
Smirman

(10) Patent No.: US 9,327,179 B2
(45) Date of Patent: May 3, 2016

(54) ADJUSTABLE SKATING BLADE SYSTEM

(71) Applicant: Marie Smirman, Rochester Hills, MI (US)

(72) Inventor: Marie Smirman, Rochester Hills, MI (US)

( * ) Notice: Subject to any disclaimer, the term of this patent is extended or adjusted under 35 U.S.C. 154(b) by 0 days.

(21) Appl. No.: 14/478,422

(22) Filed: Sep. 5, 2014

(65) Prior Publication Data

US 2015/0097347 A1 Apr. 9, 2015

Related U.S. Application Data

(60) Provisional application No. 61/873,946, filed on Sep. 5, 2013.

(51) Int. Cl.

| | |
|---|---|
| ***A63C 1/22*** | (2006.01) |
| ***A63C 1/26*** | (2006.01) |
| ***A63C 1/28*** | (2006.01) |
| ***A63C 1/34*** | (2006.01) |

(52) U.S. Cl.
CPC ..... *A63C 1/28* (2013.01)

(58) Field of Classification Search
CPC ..... A63C 1/28; A63C 1/303; A63C 1/34; A63C 1/26; A63C 1/22
USPC ..... 280/11.15, 841
See application file for complete search history.

(56) References Cited

U.S. PATENT DOCUMENTS

| | | | | |
|---|---|---|---|---|
| 1,996,925 | A * | 4/1935 | Kaub | 280/11.15 |
| 2003/0015848 | A1 * | 1/2003 | Pham et al. | 280/11.12 |
| 2004/0090023 | A1 * | 5/2004 | Crowder | 280/11.15 |

* cited by examiner

*Primary Examiner* — Bryan Evans
(74) *Attorney, Agent, or Firm* — Preston Smirman; Smirman IP Law, PLLC

(57) ABSTRACT

A piece of footwear, such as ice skating boots, is provided wherein a skating blade system is operable to be pivoted, tilted and/or rotated about at least two axes so as to enable the skating blade to be vertically aligned with the knee/upper portion of the lower leg (e.g., proximal portion of the tibia) of the skater so as to maintain proper balance. The adjustable skating blade system can provide the corrected foot with adequate balance relative to the skating blade during typical ice skating maneuvers. The skating blade system may include a skating blade and at least one mounting system. The mounting system may be provided on the underside surface of the sole and/or heel platform of the skating boot. The mounting system may be positioned at the heel, toe, and/or the mid-foot positions of the underside surface of the sole and/or heel platform of the ice skating boot.

3 Claims, 7 Drawing Sheets

ADJUSTABLE SKATING BLADE SYSTEM

CROSS-REFERENCE TO RELATED APPLICATION

The instant application claims priority to U.S. Provisional Patent Application Ser. No. 61/873,946, filed Sep. 5, 2013, the entire specification of which is expressly incorporated herein by reference.

FIELD OF THE INVENTION

The present invention relates generally to ice skating boots, and, more specifically to a skating blade system that is operable to pivot, tilt and/or rotate about at least two axes.

BACKGROUND OF THE INVENTION

Conventional skating boots are typically constructed with a relatively stiff leather upper built about a boot-like sole and heel platform, which are likewise relatively stiff. Accordingly, when the wearer's foot is placed into the skating boot, and the skating boot is laced up, unless the skating boot essentially form fits the wearer's foot, or the wearer has a relatively straight lower leg (e.g., tibia relative to the vertical axis extending downwardly through the knee), some wearer's feet have a tendency to roll about the ankle joint (e.g., display eversion and/or inversion characteristics). This situation is especially problematic for individuals with existing pronation and/or supination conditions. For example, some of these individuals may have "bowed" lower legs (e.g., laterally or medially), and as a result, the supinators and/or the pronators attempt to compensate by maintaining a neutral or level foot posture relative to the skating blade. In these situations, the wearer of the skating boot attempts to keep the skating blade vertically aligned with the knee/upper portion of the lower leg (e.g., proximal portion of the tibia) so as to maintain proper balance. However, because the toe cap of the skating boot forces the wearer's toes and/or forefoot down onto the foot bed surface, and because typical ice skating maneuvers with ice skating boots require the foot to be able to balance on a point of a rockered skating blade, it is virtually impossible for the wearer to consistently and constantly maintain proper balance, especially if one or both of the wearer's feet naturally pronates and/or supinates to any significant degree. Needless to say, skating performance would be expected to significantly suffer under these particular circumstances.

If the ice skater's foot is not properly positioned in order to maintain constant and consistent balance over the skating blade, the muscles, bones, tendons and ligaments of the skater's foot (as well as other parts of the body) can become stressed and/or injured as the ankle repeatedly rolls, or attempts to roll, either laterally or medially. However, conventional skating blades, once attached to an underside surface of the sole of a skating boot are impossible to adjust in any direction and/or axis.

Therefore, it would be advantageous to provide a new and improved piece of footwear, such as but not limited to ice skating boots, for correcting a pronation and/or supination condition such that the skating blade is vertically aligned with the knee/upper portion of the lower leg (e.g., proximal portion of the tibia) so as to maintain proper balance, that overcomes at least one of the aforementioned problems.

BRIEF DESCRIPTION OF THE DRAWINGS

Other advantages of the present invention will be readily appreciated as the same becomes better understood by reference to the following detailed description when considered in connection with the accompanying drawings wherein.

The same reference numerals refer to the same parts throughout the various Figures.

SUMMARY OF THE INVENTION

Figure 1:
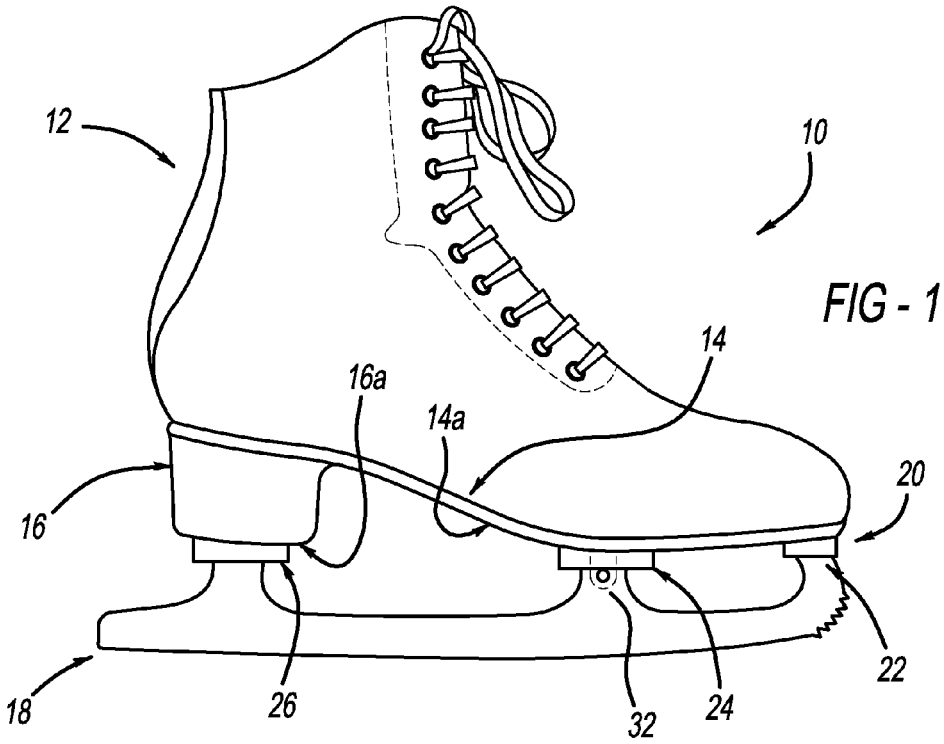
FIG. 1 is an elevational schematic view of a skating boot system, in accordance with a first embodiment of the present invention.
Figure 2:
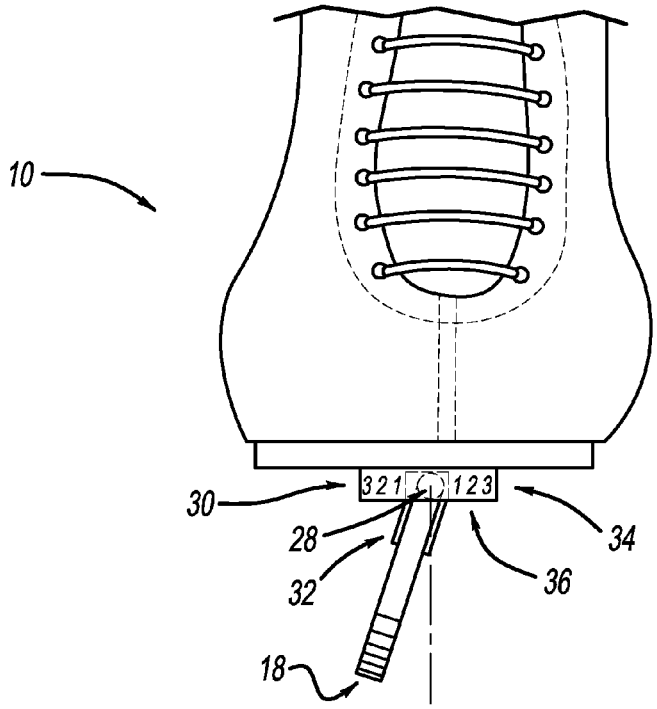
FIG. 2 is a partial front schematic view of a skating boot system wherein the skating blade member has been pivoted to the left from an initial perpendicular position, in accordance with a second embodiment of the present invention.
Figure 3:
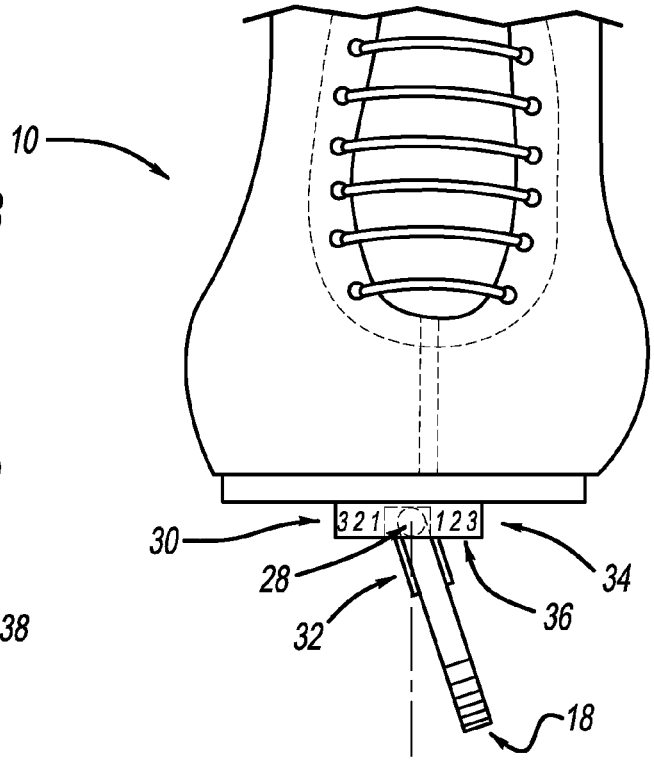
FIG. 3 is a partial front schematic view of a skating boot system wherein the skating blade member has been pivoted to the right from an initial perpendicular position, in accordance with a third embodiment of the present invention.
Figure 4:
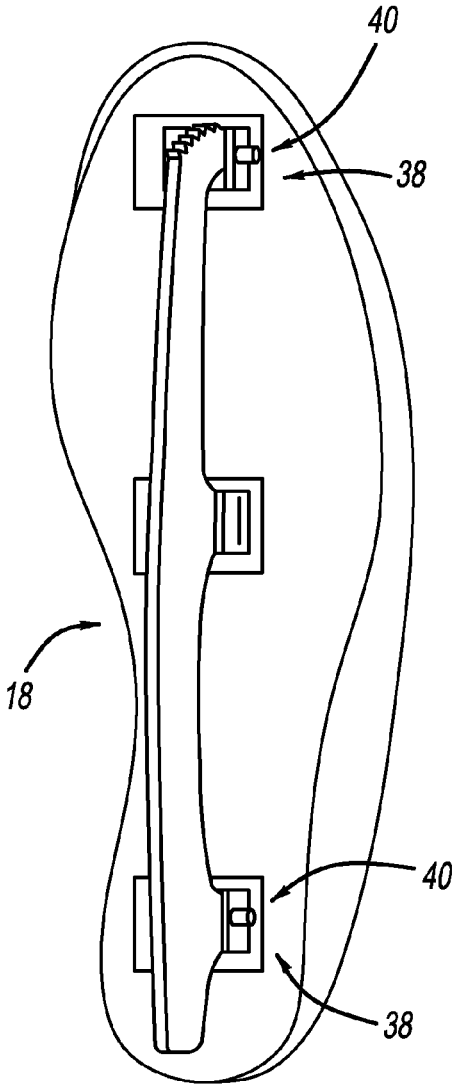
FIG. 4 is a bottom schematic view of a skating boot system wherein the skating blade member has been pivoted to the left from an initial perpendicular position, in accordance with a fourth embodiment of the present invention.
Figure 5:
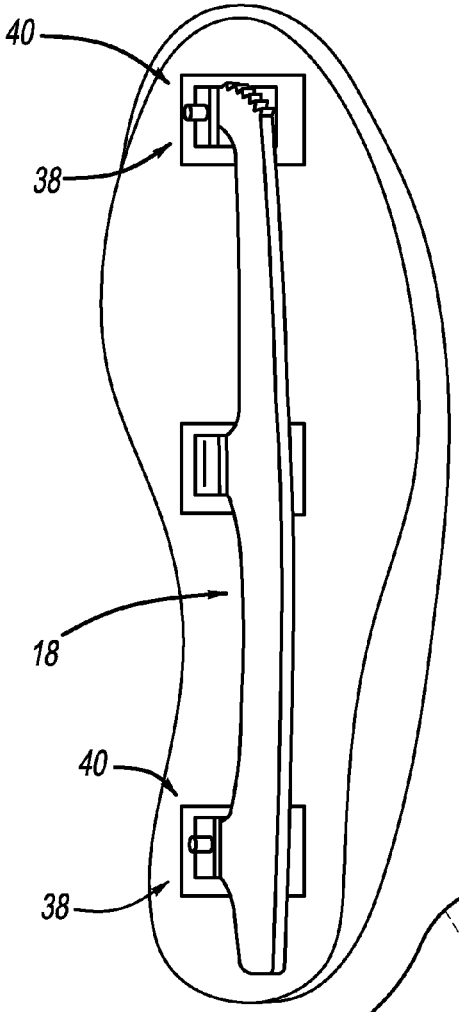
FIG. 5 is a bottom schematic view of a skating boot system wherein the skating blade member has been pivoted to the right from an initial perpendicular position, in accordance with a fifth embodiment of the present invention.
Figure 6:
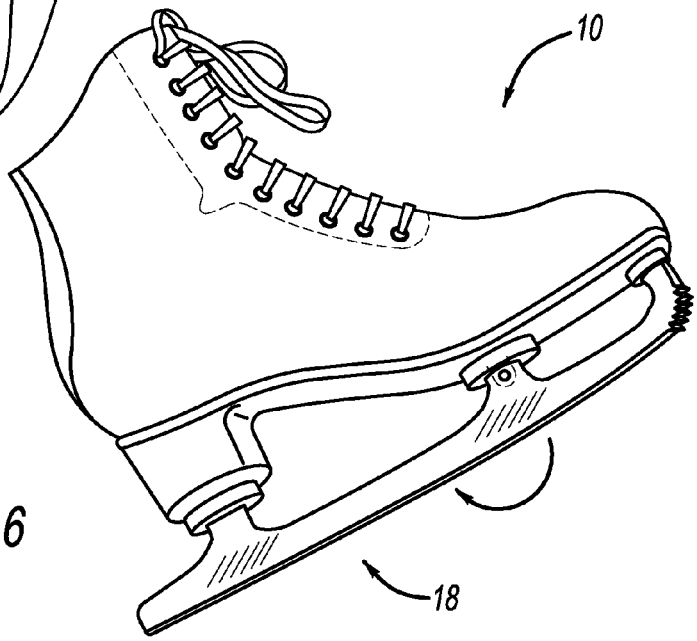
FIG. 6 is a perspective schematic view of a skating boot system wherein the skating blade member has been pivoted to the right from an initial perpendicular position, in accordance with a sixth embodiment of the present invention.
Figure 7:
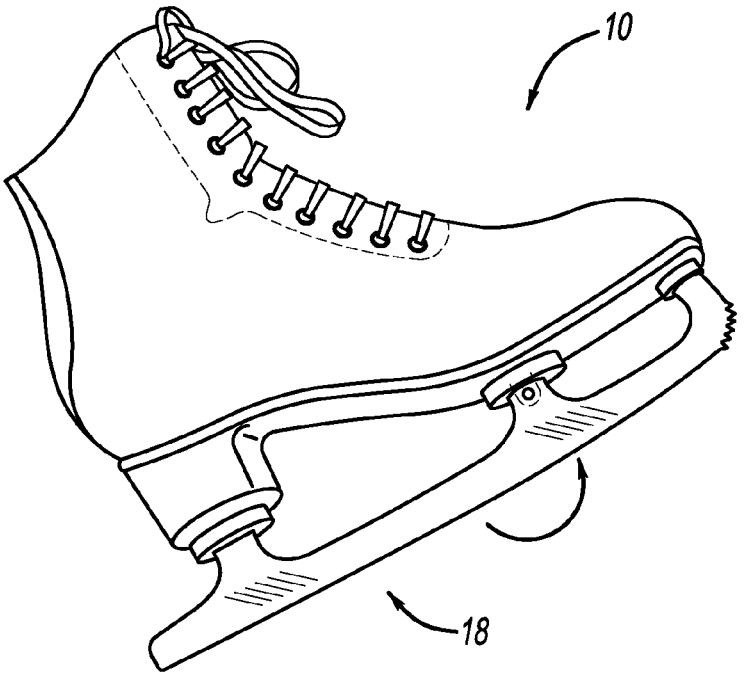
FIG. 7 is a perspective schematic view of a skating boot system wherein the skating blade member has been pivoted to the left from an initial perpendicular position, in accordance with a seventh embodiment of the present invention.
Figure 8:
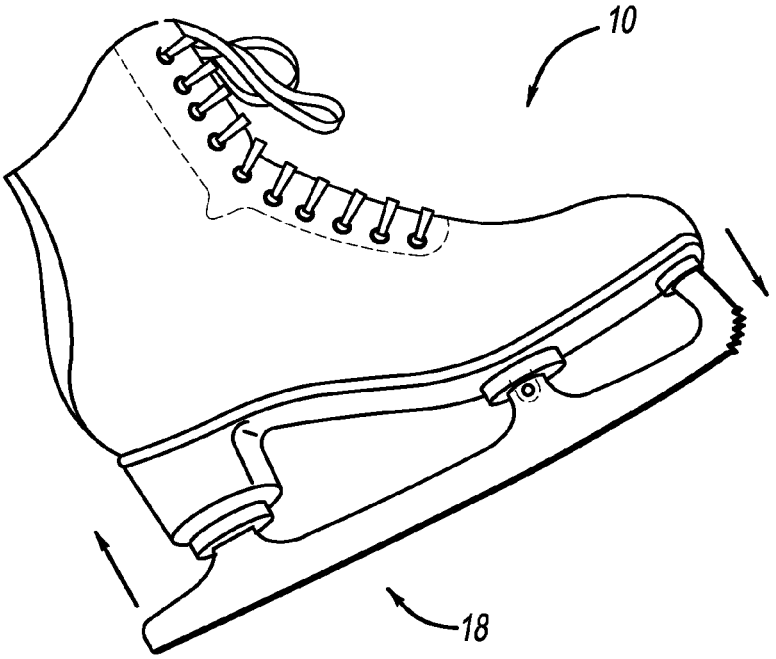
FIG. 8 is a perspective schematic view of a skating boot system wherein the skating blade member has been pivoted downwardly away from the underside surface of the toe portion of the skating boot, in accordance with an eighth embodiment of the present invention.
Figure 9:
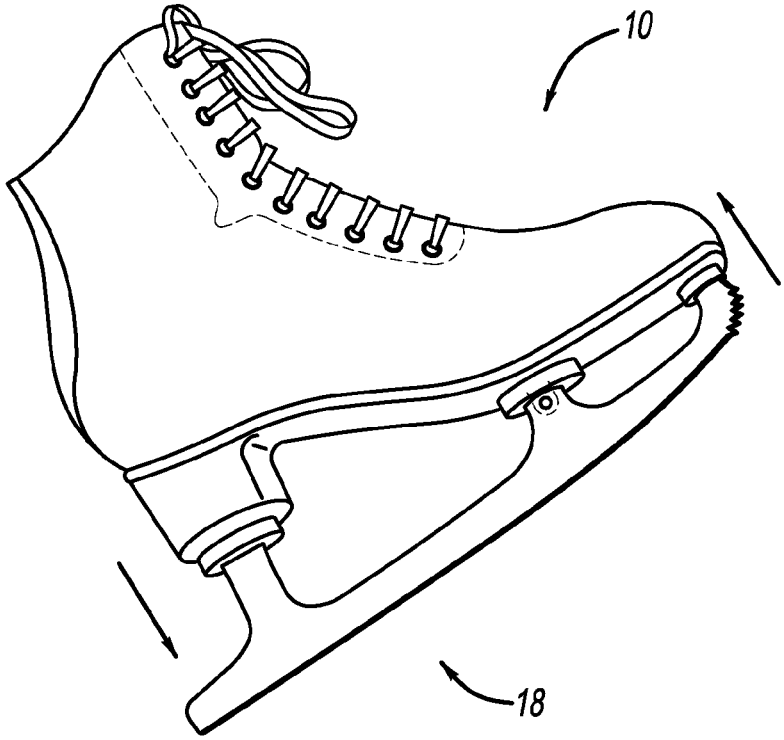
FIG. 9 is a perspective schematic view of a skating boot system wherein the skating blade member has been pivoted upwardly towards the underside surface of the toe portion of the skating boot, in accordance with a ninth embodiment of the present invention.
Figure 10:
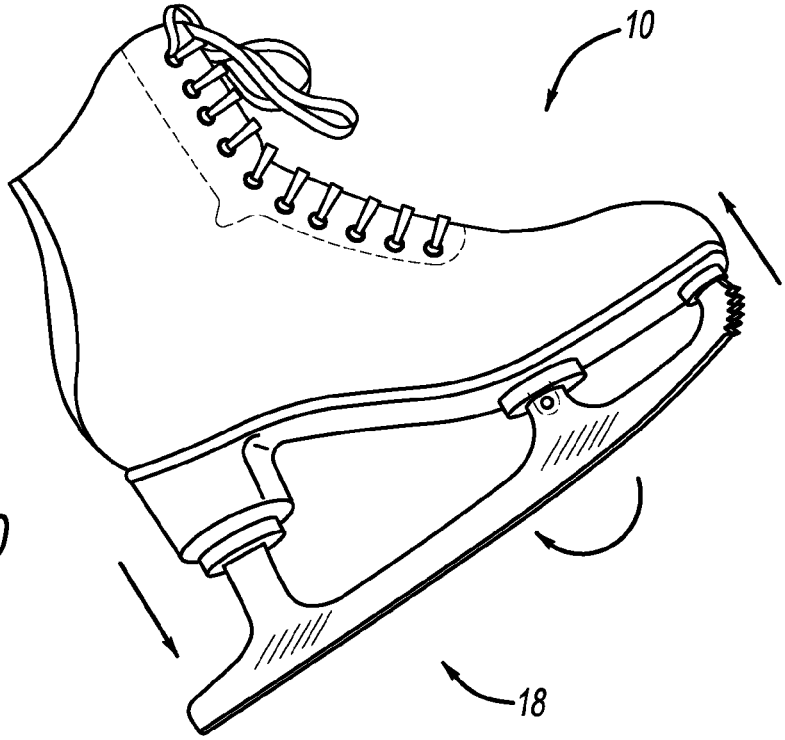
FIG. 10 is a perspective schematic view of a skating boot system wherein the skating blade member has been pivoted to the right from an initial perpendicular position and also pivoted upwardly towards the underside surface of the toe portion of the skating boot, in accordance with a tenth embodiment of the present invention.
Figure 11:
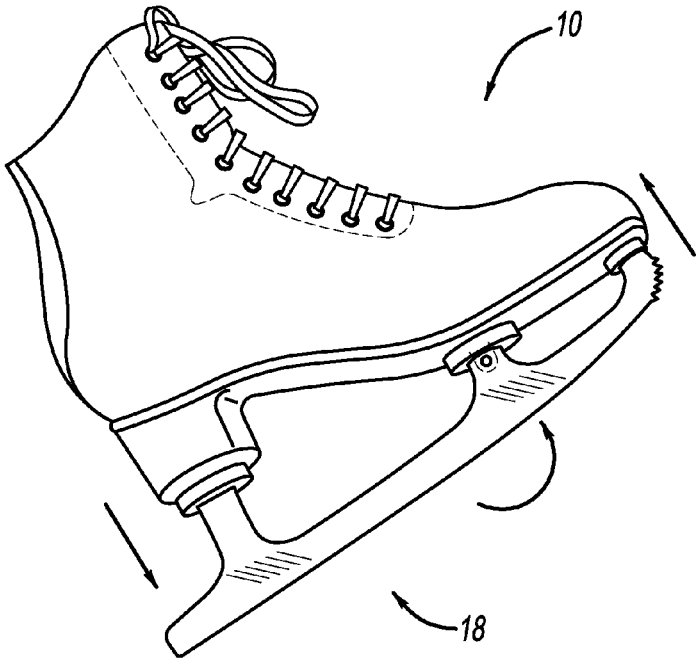
FIG. 11 is a perspective schematic view of a skating boot system wherein the skating blade member has been pivoted to the left from an initial perpendicular position and also pivoted upwardly towards the underside surface of the toe portion of the skating boot, in accordance with an eleventh embodiment of the present invention.
Figure 12:
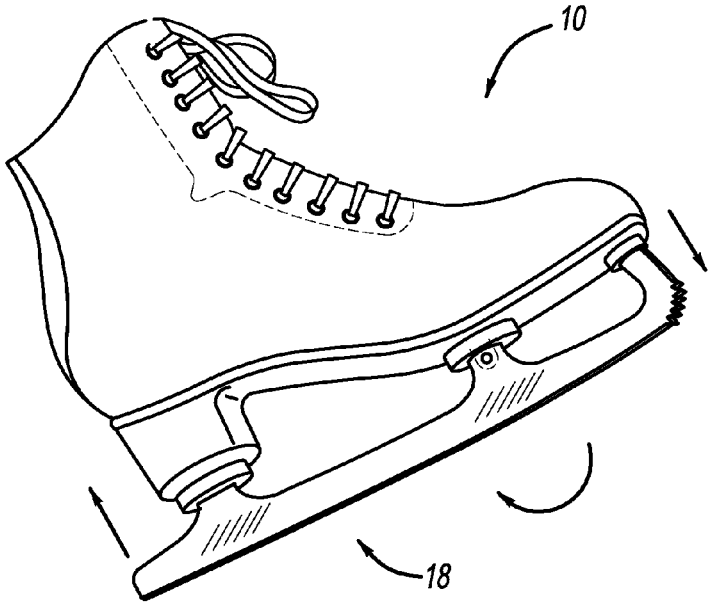
FIG. 12 is a perspective schematic view of a skating boot system wherein the skating blade member has been pivoted to the right from an initial perpendicular position and also pivoted downwardly away from the underside surface of the toe portion of the skating boot, in accordance with a twelfth embodiment of the present invention.
Figure 13:
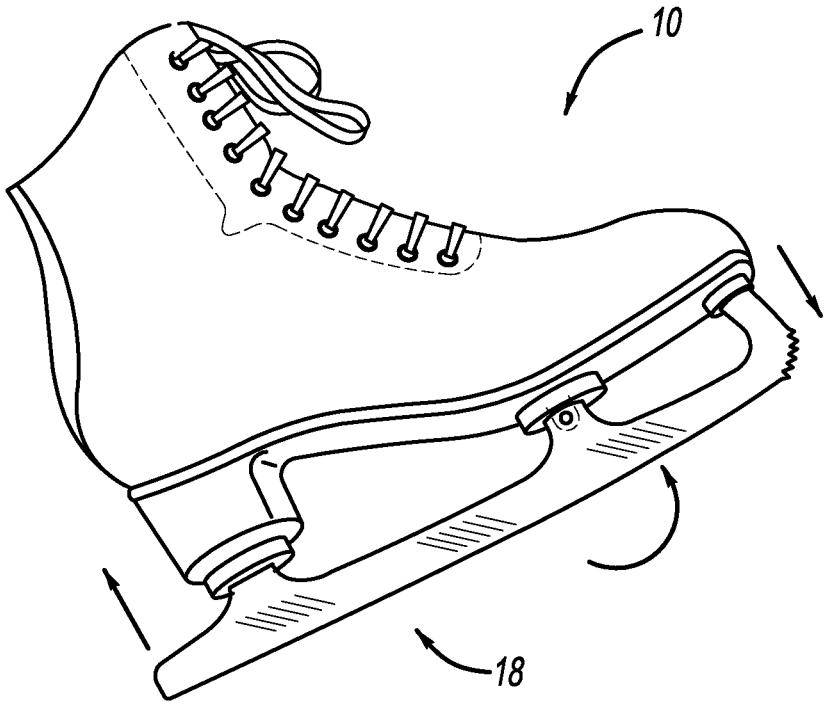
FIG. 13 is a perspective schematic view of a skating boot system wherein the skating blade member has been pivoted to the left from an initial perpendicular position and also pivoted downwardly away from the underside surface of the toe portion of the skating boot, in accordance with a thirteenth embodiment of the present invention.

In accordance with the general teachings of the present invention, a new and improved piece of footwear, such as but not limited to ice skating boots, is provided for correcting a pronation and/or supination condition wherein a skating blade system is operable to be pivoted, tilted and/or rotated about at least two axes so as to enable the skating blade to be vertically aligned with the knee/upper portion of the lower leg (e.g., proximal portion of the tibia) of the skater so as to maintain proper balance. In this manner, the adjustable skating blade system can provide the skater's foot with adequate balance relative to the skating blade during typical ice skating maneuvers.

More specifically, the skating blade system includes a blade member and at least one mounting system. The mounting system may be provided on the underside surface of the sole of the skating boot. Furthermore, the mounting system may be positioned at the heel position, the toe position, the mid-foot position of the underside surface of the sole of the skating boot, and/or any combination thereof.

In accordance with one embodiment of the present invention, a single mounting system may be provided at the mid-foot position of the underside surface of the sole, wherein a skating blade may be mounted to the mounting system. The skating blade may then be selectively pivoted, tilted and/or rotated about at least two axes (relative to the mounting system), so as to provide inboard/outboard adjustment (e.g., left/right or medially/laterally depending on the skating boot) and/or up/down adjustment of the skating blade (e.g., moving the skating blade towards or away from the underside surface of the sole.

In accordance with another embodiment of the present invention, two mounting systems may be provided at the heel position and the toe position of the underside surface of the sole, wherein a skating blade may be mounted to the respective mounting systems. The skating blade may then be selectively pivoted, tilted and/or rotated about at least two axes (relative to the mounting system), so as to provide inboard/outboard adjustment (e.g., left/right or medially/laterally depending on the skating boot) and/or up/down adjustment of the skating blade (e.g., moving the skating blade towards or away from the underside surface of the sole).

In accordance with still another embodiment of the present invention, two mounting systems may be provided at the heel position and/or the toe position, as well as the mid-foot position, of the underside surface of the sole, wherein a skating blade may be mounted to the respective mounting systems. The skating blade may then be selectively pivoted, tilted and/or rotated about at least two axes (relative to the mounting system), so as to provide inboard/outboard adjustment (e.g., left/right or medially/laterally depending on the skating boot) and/or up/down adjustment of the skating blade (e.g., moving the skating blade towards or away from the underside surface of the sole) to correct for heel height issues. In this manner, the wearer of the skating boot is then able to keep the skating blade vertically aligned with the knee/upper portion of the lower leg (e.g., proximal portion of the tibia) so as to maintain proper balance.

In accordance with still yet another embodiment of the present invention, three mounting systems may be provided at the heel position, the toe position, and the mid-foot position of the underside surface of the sole, wherein a skating blade may be mounted to the respective mounting systems. The skating blade may then be selectively pivoted, tilted and/or rotated about at least two axes (relative to the mounting system), so as to provide inboard/outboard adjustment (e.g., left/right or medially/laterally depending on the skating boot) and/or up/down adjustment of the skating blade (e.g., moving the skating blade towards or away from the underside surface of the sole.

It should be appreciated that more than three mounting systems may be provided at additional locations of the underside surface of the sole, e.g., in addition to the heel position, the toe position, and the mid-foot position.

In accordance with one aspect of the present invention, the mechanisms for allowing pivoting and/or rotation about at least two axes may be provided in any number of ways. By way of a non-limiting example, a ball joint may be provided for allowing inboard/outboard movement of the skating blade as well as up/down movement of the skating blade. However, it should be appreciated that other mechanisms may also be employed as well, including but not limited to swivel joints (e.g., formed or located on the skate blade itself to allow up and down movement of the skate blade independent of any side to side movement of the skate blade), pawl and ratchet systems, protractor systems (e.g., a telescoping protractor system), springs, and/or the like.

In accordance with another aspect of the present invention, an indexing system may be provided to allow the user to determine the amount of movement (e.g., the number of degrees) of the skating blade in the two or more axes. The indexing mechanism may include any number of devices, including, but not limited to a pointer, protractor system (e.g., a telescoping protractor system), a degree marked clamp, bolt, screw, and/or the like. In this manner, the skating blade may be accurately adjusted, e.g., in two or more axes if necessary.

In accordance with another aspect of the present invention, a securing mechanism may be employed to lock or secure the skating blade in a fixed position once the desired position of the skating blade has been attained. The securing mechanism may include any number of devices, including, but not limited to struts, clamps, cotter pins (e.g., in conjunction with a tube-in-tube height adjustment system), nuts and bolts, screws, pawl and ratchet systems, and/or the like. In this manner, not only can the left/right or medial/lateral tilt of the skating blade be fixed, but the up/down adjustment of the skating blade can also be fixed. The skater may then safely and confidently use the skating boot to ice skate without fear that the skating blade will move out of the desired position, e.g., in either of the two axes (assuming there was an adjustment of the initial position of the skating blade in both of the two axes).

In accordance with a first illustrative embodiment of the present invention, a skating blade system is provided, comprising:

a skating blade member; and a mounting system operably associated with the skating blade member;

wherein the mounting system includes a pivot mechanism operably associated with a portion of the skating blade member;

wherein the mechanism is selectively operable to permit the skating blade member to pivot about two axes.

In accordance with a second illustrative embodiment of the present invention, a skating blade system is provided, comprising:

a skating blade member;

a mounting system operably associated with the skating blade member;

wherein the mounting system includes a pivot mechanism operably associated with a portion of the skating blade member;

wherein the mechanism is selectively operable to permit the skating blade member to pivot about two axes;

a securing system to secure the skating blade member in a fixed position; and an indexing system operably associated with the mounting system and selectively operable to indicate a number of degrees that the skate blade member has been pivoted about the two axes.

In accordance with a third illustrative embodiment of the present invention, a skating boot system is provided, comprising:

a skating boot;

a skating blade system operably associated with the skating boot, the skating blade system comprising:

a skating blade member;

a mounting system operably associated with the skating blade member, wherein the mounting system is selectively operable to be mounted to an underside surface of the skating boot;

wherein the mounting system includes a pivot mechanism operably associated with a portion of the skating blade member;

wherein the mechanism is selectively operable to permit the skating blade member to pivot about two axes;

a securing system to secure the skating blade member in a fixed position; and an indexing system operably associated with the mounting system and selectively operable to indicate a number of degrees that the skate blade member has been pivoted about the two axes.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE INVENTION

The following description of the preferred embodiment(s) is merely exemplary in nature and is in no way intended to limit the invention, or uses.

Referring to the Figures, an ice skating boot system includes a skating boot 10 that includes a relatively stiff leather upper 12 built about a boot-like sole 14 and heel platform 16, which are likewise relatively stiff. A skating blade member 18 is adjustably fastened to a portion of the underside surfaces 14*a*, 16*a*, respectively, of the sole 14 and heel platform 16.

In a conventional ice skating boot, the skating blade member would be fastened (typically with screws through one or more mounting plates formed on the skating blade member) directly to the respective underside surfaces of the sole and heel platform such that the skating blade member is, when viewing the boot head on, essentially perpendicular to the respective underside surfaces of the sole and heel platform, i.e., there is no discernable side to side "tilt" of the skating blade member, and, when viewing the boot from the side, essentially parallel to the respective underside surfaces of the sole and heel platform, i.e., there is no discernable up or down "tilt" of the skating blade member.

The present invention overcomes this limitation by providing a mounting system 20 that may include one or more mounting platforms 22, 24, 26, respectively, that allows the skating blade member 18 pivot, rotate or otherwise move in a side to side and/or up or down direction relative to the sole 14 and heel platform 16 before being secured in a fixed orientation or position. That is, the mounting system 20 is operable to enable the skating blade member 18 to be pivoted, tilted and/or rotated about at least two axes so as to enable the skating blade member 18 to be vertically aligned with the knee/upper portion of the lower leg (e.g., proximal portion of the tibia) of the skater so as to maintain proper balance. In this manner, the adjustable skating blade system can provide the skater's foot with adequate balance relative to the skating blade during typical ice skating maneuvers.

By way of a non-limiting example, the mounting platforms 22, 24, 26, respectively, may be provided on the underside surface 14*a* of the sole 14 and/or the underside surface 16*a* of the heel platform 16. Accordingly, the mounting platforms 22, 24, 26, respectively, may be positioned at the heel position, the toe position and/or the mid-foot position of the underside surface 14*a* of the sole 14 and/or the underside surface 16*a* of the heel platform 16 of the ice skating boot 10, and/or any combination thereof.

It should be appreciated that less than three mounting platforms may also be employed in the practice of the present invention.

By way of a non-limiting example, a single mounting platform may be provided at the mid-foot position of the underside surface 14*a* of the sole 14, wherein the skating blade member 18 may be mounted thereto. The skating blade member 18 may then be selectively pivoted, tilted and/or rotated about at least two axes (relative to the mounting platform), so as to provide inboard/outboard adjustment (e.g., left/right or medially/laterally depending on the ice skating boot) and/or up/down adjustment of the skating blade member 18 (e.g., moving the skating blade member 18 towards or away from the underside surface 14*a* of the sole 14.

By way of another non-limiting example, two mounting platforms may be provided at the heel position and the toe position of the underside surface 14*a* of the sole 14, wherein the skating blade member 18 may be mounted to the respective mounting platforms. The skating blade member 18 may then be selectively pivoted, tilted and/or rotated about at least two axes (relative to the mounting platforms), so as to provide inboard/outboard adjustment (e.g., left/right or medially/laterally depending on the ice skating boot 10) and/or up/down adjustment of the skating blade member 18 (e.g., moving the skating blade member 18 towards or away from the underside surface 14*a* of the sole 14).

By way of still another non-limiting example, two mounting platforms may be provided at the heel position and/or the toe position, as well as the mid-foot position, of the underside surface 14*a* of the sole 14, wherein the skating blade member 18 may be mounted to the respective mounting platforms. The skating blade member 18 may then be selectively pivoted, tilted and/or rotated about at least two axes (relative to the mounting platforms), so as to provide inboard/outboard adjustment (e.g., left/right or medially/laterally depending on the ice skating boot) and/or up/down adjustment of the skating blade member 18 (e.g., moving the skating blade member 18 towards or away from the underside surface 14*a* of the sole 14) to correct for heel height issues. In this manner, the wearer of the ice skating boot 10 is then able to keep the skating blade member 18 vertically aligned with the knee/upper portion of the lower leg (e.g., proximal portion of the tibia) so as to maintain proper balance.

It should also be appreciated that more than three mounting platforms may be provided at additional locations of the underside surface 14*a* of the sole 14 and/or the underside surface 16*a* of the heel platform 16, e.g., in addition to the heel position, the toe position, and the mid-foot position.

In accordance with one aspect of the present invention, the mechanisms for allowing pivoting, tilting and/or rotation about at least two axes may be provided in any number of ways. By way of a non-limiting example, a ball joint 28 (e.g., operable to swivel or rotate within a housing 30 of one or more of the mounting platforms 22, 24, 26, respectively) may be provided for allowing inboard/outboard movement of the skating blade member 18 as well as up/down movement of the skating blade member 18. However, it should be appreciated that other mechanisms may also be employed as well, including but not limited to swivel joints 32 (e.g., formed or located on the skate blade member 18 itself to allow up and down movement of the skate blade member 18 independent of any side to side movement of the skate blade member 18), pawl and ratchet systems, protractor systems (e.g., a telescoping protractor system), springs, and/or the like. By way of a non-limiting example, the ball joint 28 may be provided in conjunction with the mounting platform 24.

In accordance with another aspect of the present invention, an indexing system 34 may be provided to allow the user to determine the amount of movement (e.g., the number of degrees) of the skating blade member 18 in the two or more axes. An indexing mechanism 36 operably associated with the indexing system 34 may include any number of devices, including, but not limited to a pointer, protractor system (e.g., a telescoping protractor system), a degree marked clamp, bolt, screw, and/or the like. In this manner, the skating blade member 18 may be accurately adjusted, e.g., in two or more axes if necessary. By way of a non-limiting example, the indexing mechanism 36 may be provided in conjunction with any, or all, of the mounting platforms 22, 24, 26, respectively.

In accordance with another aspect of the present invention, a securing system 38 may be employed to lock or secure the skating blade member 18 in a fixed position once the desired position of the skating blade member 18 has been attained. A securing mechanism 40 operably associated with the securing system 38 may include any number of devices, including, but not limited to struts, clamps, cotter pins (e.g., in conjunction with a tube-in-tube height adjustment system), nuts and bolts, screws, pawl and ratchet systems, and/or the like. In this manner, not only can the left/right or medial/lateral tilt of the skating blade member 18 be fixed, but the up/down adjustment of the skating blade member 18 can also be fixed. The skater may then safely and confidently use the ice skating boot 10 to ice skate without fear that the skating blade member 18 will move out of the desired position, e.g., in either of the two axes (assuming there was an adjustment of the initial position of the skating blade in both of the two axes).

While the invention has been described with reference to an exemplary embodiment, it will be understood by those skilled in the art that various changes can be made and equivalents can be substituted for elements thereof without departing from the scope of the invention. In addition, many modifications can be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A skating blade system for a skating boot, wherein the skating boot includes a sole, comprising:

a skating blade member; and a mounting system mounted to an underside surface of the sole and operably associated with the skating blade member;

wherein the mounting system includes a pivot mechanism operably associated with a portion of the skating blade member;

wherein the pivot mechanism is selectively operable to permit the skating blade member to pivot independently about two axes;

wherein the pivot mechanism is selectively operable to independently pivot the skating blade member towards or away from the underside surface of the sole and angularly inboard or outboard relative to a vertical axis extending downwardly from the underside surface of the sole and a securing system to secure the skating blade member in a fixed position.

2. A skating blade system for a skating boot, wherein the skating boot includes a sole, comprising:

a skating blade member;

a mounting system mounted to an underside surface of the sole and operably associated with the skating blade member;

wherein the mounting system includes a pivot mechanism operably associated with a portion of the skating blade member;

wherein the pivot mechanism is selectively operable to permit the skating blade member to independently pivot about two axes;

wherein the pivot mechanism is selectively operable to independently pivot the skating blade member towards or away from the underside surface of the sole and angularly inboard or outboard relative to a vertical axis extending downwardly from the underside surface of the sole;

a securing system to secure the skating blade member in a fixed position; and an indexing system operably associated with the mounting system and selectively operable to indicate a number of degrees that the skate blade member has been pivoted about the two axes.

3. A skating boot system, comprising:

a skating boot, wherein the skating boot includes a sole;

a skating blade system operably associated with the skating boot, the skating blade system comprising:

a skating blade member;

a mounting system operably associated with the skating blade member, wherein the mounting system is mounted to an underside surface of the sole;

wherein the mounting system includes a pivot mechanism operably associated with a portion of the skating blade member;

wherein the pivot mechanism is selectively operable to permit the skating blade member to independently pivot about two axes;

wherein the pivot mechanism is selectively operable to independently pivot the skating blade member towards or away from the underside surface of the sole and angularly inboard or outboard relative to a vertical axis extending downwardly from the underside surface of the sole;

a securing system to secure the skating blade member in a fixed position; and an indexing system operably associated with the mounting system and selectively operable to indicate a number of degrees that the skate blade member has been pivoted about the two axes.

* * * * *